US011031203B2

(12) United States Patent
Sugisawa et al.

(10) Patent No.: US 11,031,203 B2
(45) Date of Patent: Jun. 8, 2021

(54) CONTACT POINT DEVICE AND ELECTROMAGNETIC RELAY

(71) Applicants: DENSO ELECTRONICS CORPORATION, Anjo (JP); TOYOTA JIDOSHA KABUSHIKI KAISHA, Toyota (JP)

(72) Inventors: Masanao Sugisawa, Anjo (JP); Makoto Motono, Nisshin (JP)

(73) Assignees: DENSO ELECTRONICS CORPORATION, Anjo (JP); TOYOTA JIDOSHA KABUSHIKIKAISHA, Toyota (JP)

( * ) Notice: Subject to any disclaimer, the term of this patent is extended or adjusted under 35 U.S.C. 154(b) by 177 days.

(21) Appl. No.: 16/468,407

(22) PCT Filed: Nov. 2, 2017

(86) PCT No.: PCT/JP2017/039651
§ 371 (c)(1),
(2) Date: Jun. 11, 2019

(87) PCT Pub. No.: WO2018/135084
PCT Pub. Date: Jul. 26, 2018

(65) Prior Publication Data

US 2020/0381204 A1 Dec. 3, 2020

(30) Foreign Application Priority Data

Jan. 18, 2017 (JP) ..... JP2017-006932

(51) Int. Cl.
*H01H 50/54* (2006.01)

(52) U.S. Cl.
CPC ..... *H01H 50/54* (2013.01)

(58) Field of Classification Search
CPC ..... H01H 50/54; H01H 1/06; H01H 1/32; H01H 50/546
See application file for complete search history.

(56) References Cited

U.S. PATENT DOCUMENTS 2,740,022 A * 3/1956 Simpson ..... H01H 1/32 200/248
3,286,049 A * 11/1966 Drain ..... H01H 1/14 200/16 A (Continued)

FOREIGN PATENT DOCUMENTS

JP 2012199117 A 10/2012
JP 2015035321 A 2/2015

*Primary Examiner* — Mohamad A Musleh
(74) *Attorney, Agent, or Firm* — Hamess, Dickey & Pierce, P.L.C.

(57) ABSTRACT

A contact point device includes a first contactor, an oscillation supporting portion, and a second contactor. The first contactor has an outer side surface shaped in a column that surrounds a central axis. The oscillation supporting portion supports the first contactor to allow the central axis to oscillate. The second contactor is disposed opposite to the first contactor. One of the first contactor and the second contactor includes a plurality of first contact portions provided to surround the central axis on a plane perpendicular to the central axis, and the other includes a second contact portion provided to protrude toward a space surrounded by the plurality of the first contact portions. The second contact portion has a contact surface which is a curved surface exposed toward the space to surround the central axis.

15 Claims, 7 Drawing Sheets

(56) References Cited

U.S. PATENT DOCUMENTS

| | | | | |
|---|---|---|---|---|
| 5,527,591 | A * | 6/1996 | Crotzer | H01H 1/06<br>428/209 |
| 2015/0042422 | A1 | 2/2015 | Horiguchi et al. | |
| 2015/0301081 | A1* | 10/2015 | Hirano | G01R 3/00<br>324/755.01 |
| 2015/0303014 | A1* | 10/2015 | Lee | H01H 50/54<br>335/203 |

* cited by examiner

CONTACT POINT DEVICE AND ELECTROMAGNETIC RELAY

CROSS REFERENCE TO RELATED APPLICATIONS

This application is a U.S. National Phase Application under 35 U.S.C. 371 of International Application No. PCT/JP2017/039651 filed on Nov. 2, 2017. This application is based on and claims the benefit of priority from Japanese Patent Application No. 2017-006932 filed on Jan. 18, 2017. The entire disclosures of all of the above applications are incorporated herein by reference.

TECHNICAL FIELD

The present disclosure relates to a contact point device and an electromagnetic relay.

BACKGROUND ART

A contact point device described in Patent Document 1 includes two fixed contact points, and a movable contactor having two movable contact points. A slit is formed in one of the movable contact points. The fixed contact point corresponding to the one of the movable contact points comes into contact with the one of the movable contact points at both sides of the slit. As a result, the contact state between the movable contactor and the fixed contact point is stabilized.

PRIOR ART DOCUMENTS

Patent Document

Patent Document 1: JP 2012-199117 A

SUMMARY

This type of device is used, for example, in an electric vehicle such as a hybrid vehicle, for switching on or off an electric circuit between a motor drive circuit and a battery. In recent electric vehicles, the current between the motor drive circuit and the battery tends to increase as the running performance improves. Therefore, in this type of device, it is required to further reduce the contact resistance between the contact points. The present disclosure has been made in view of the circumstances exemplified above, and it is an object thereof to provide a contact point device and an electromagnetic relay.

In one aspect of the present disclosure, the contact point device is configured to switch an electric current to flow or not by relative movement between a movable portion and a fixed portion.

The contact point device includes:

a first contactor provided on one of the movable portion and the fixed portion as a conductive contact member having an outer side surface shaped in a column that surrounds a central axis along a relative movement direction of the movable portion and the fixed portion;

an oscillation supporting portion that supports the first contactor at the one of the movable portion and the fixed portion to allow the central axis to oscillate; and a second contactor provided on the other of the movable portion and the fixed portion as a conductive contact member disposed opposite to the first contactor in the relative movement direction so as to be electrically connected to the first contactor by abutting against the first contactor.

One of the first contactor and the second contactor includes a plurality of first contact portions. The plurality of first contact portions are provided to surround the central axis on a plane orthogonal to the central axis.

The other of the first contactor and the second contactor, which is different from the one of the first contactor and the second contactor, includes a second contact portion. The second contact portion protrudes in the relative movement direction toward a space surrounded by the plurality of first contact portions.

The second contact portion has a contact surface which is a curved surface exposed toward the space to surround the central axis.

In another aspect of the present disclosure, an electromagnetic relay is configured to switch an electric current to flow or not by a movement of a movable portion relative to a fixed portion in a coil axis direction based on an energization state of a coil.

The electromagnetic relay includes:

a first contactor provided on one of the movable portion and the fixed portion as a conductive contact member having an outer side surface shaped in a column that surrounds a central axis along the coil axis direction;

an oscillation supporting portion that supports the first contactor at the one of the movable portion and the fixed portion to allow the central axis to oscillate; and a second contactor provided on the other of the movable portion and the fixed portion as a conductive contact member disposed opposite to the first contactor in the coil axis direction so as to be electrically connected to the first contactor by abutting against the first contactor.

One of the first contactor and the second contactor includes a plurality of first contact portions. The plurality of first contact portions are provided to surround the central axis on a plane perpendicular to the central axis.

The other of the first contactor and the second contactor, which is different from the one of the first contactor and the second contactor, includes a second contact portion. The second contact portion protrudes in the coil axis direction toward a space surrounded by the plurality of first contact portions.

The second contact portion has a contact surface which is a curved surface exposed toward the space to surround the central axis.

DETAILED DESCRIPTION

Hereinafter, an embodiment of the present disclosure is described with reference to the drawings. Various modifications applicable to the embodiment will be collectively described as modifications after the description of the embodiment.

(Schematic Configuration of Electromagnetic Relay)

Figure 1:
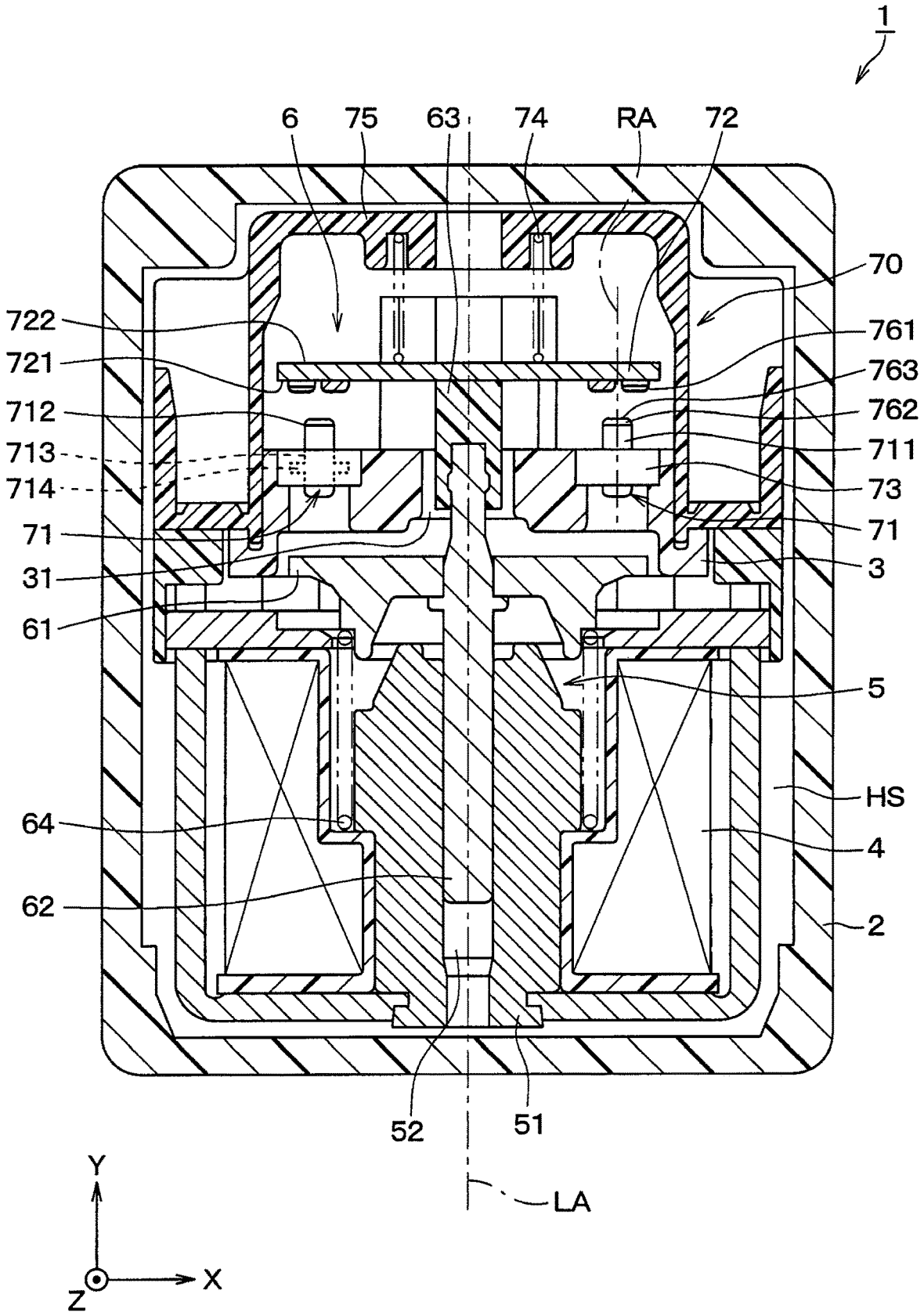
FIG. 1 is a cross-sectional view illustrating a schematic configuration of an electromagnetic relay and a contact point device according to an embodiment.

The schematic configuration of the electromagnetic relay 1 according to the embodiment will be described with reference to FIG. 1. The electromagnetic relay 1 includes a housing 2, a frame 3, a coil 4, a fixed portion 5, and a movable portion 6. FIG. 1 shows a state in which the coil 4 is not energized.

The electromagnetic relay 1 has a so-called plunger structure suitably applied to a power transmission path between a battery and a drive circuit for an electric motor in an electric vehicle. That is, in the electromagnetic relay 1, the movable portion 6 linearly moves relative to the fixed portion 5 along the coil axis direction in accordance with the energization state of the coil 4, thereby switching the electric current to allow the electric current to flow or not. The coil axial direction is a direction parallel to the coil axis LA which is the central axis of the coil 4.

In FIG. 1, the Y-axis direction is taken as the coil axis direction in the XYZ three-dimensional coordinate system of the right hand base. Also, a direction parallel to the X-axis is referred to as a "width direction", and a direction parallel to the Z-axis is referred to as a "height direction". A positive direction in the Y-axis will be referred to as "return direction" and a negative direction in the Y-axis will be referred to as "suction direction". That is, the "coil axis direction" refers to a direction parallel to the Y-axis, and is used not to specify the return direction or the suction direction.

The housing 2 is a bathtub-shaped member having an opening at one side in the height direction, and is integrally formed of an insulating material such as a synthetic resin. The frame 3 has a plate-like portion (not shown) formed to close the opening of the housing 2, and a protruding portion that protrudes in the height direction from the plate-like portion. In FIG. 1, a part of the protruding portion of the frame 3 is shown. A shaft insertion hole 31 which is a through hole is formed in the illustrated protruding portion along the coil axis direction.

The coil 4, the fixed portion 5, and the movable portion 6 are supported by the frame 3. That is, the coil 4, the fixed portion 5, and the movable portion 6 are housed inside the housing space HS. The housing space HS is a space surrounded by the housing 2 and the plate-like portion of the frame 3.

The coil 4 is disposed at one end portion (that is, an end portion in the suction direction) of the housing space HS. The coil 4 is configured to relatively move the movable portion 6 in the suction direction with respect to the fixed portion 5 by generating a magnetic field by energization.

The fixed portion 5 is fixed to the frame 3. A fixed core 51 of the fixed portion 5 is a cylindrical fixed magnetic path forming member made of a ferromagnetic metal material, and is housed inside the coil 4. That is, the fixed core 51 is arranged coaxially with the coil 4. A guide hole 52 is formed in the fixed core 51. The guide hole 52 penetrates the fixed core 51 in the coil axis direction and is provided on the coil axis LA overlapping with the axial center of the fixed core 51.

The movable portion 6 is configured to move in the suction direction by the magnetic field when the coil 4 is energized and to move in the return direction when the coil 4 is de-energized. That is, the movable portion 6 is supported by the frame 3 and the fixed portion 5 so as to reciprocate along the coil axis direction.

A movable core 61 of the movable portion 6 is a substantially disk-shaped member made of a ferromagnetic metal material, and is disposed opposite to the fixed core 51 in the return direction with respect to the fixed core 51. That is, the movable core 61 is provided to move in the suction direction by being attracted to the fixed core 51 by the magnetic field when the coil 4 is energized. The movable core 61 is fixed at an intermediate portion of the movable shaft 62 in the longitudinal direction.

The movable shaft 62 is a bar-like member having a longitudinal direction parallel to the coil axis LA and is housed in the guide hole 52 of the fixed core 51 so as to be reciprocally movable along the coil axis direction. An end portion of the movable shaft 62 in the return direction is covered with a movable insulator 63 made of an insulating material such as a synthetic resin. The movable insulator 63 and an end portion of the movable shaft 62 covered with the movable insulator 63 are capable of reciprocating along the coil axis direction within the shaft insertion hole 31.

A return spring 64 is disposed to surround the fixed core 51 in the suction direction of the movable core 61. The return spring 64, which is a compression coil spring, is provided so as to bias the movable core 61 in the return direction away from the fixed core 51.

(Configuration of Contact Point Device)

The electromagnetic relay 1 includes a contact point device 70. As is apparent from the description below, the contact point device 70 is provided across the fixed portion 5 and the movable portion 6. Hereinafter, with reference to FIGS. 1 to 4, the configuration of the contact point device 70 of the present embodiment will be described in detail.

The contact point device 70 includes a first contactor 71, a second contactor 72, an oscillation supporting portion 73, a contact pressure spring 74, and a contact cover 75. In the present embodiment, the contact point device 70 is configured to switch the electric current to flow or not between the first contactor 71 and the second contactor 72 by a relative movement between the first contactor 71 provided at the fixed portion 5 and the second contactor 72 provided at the movable portion 6.

The first contactor 71 is a conductive contact member formed of a conductive metal, and has an outer side surface 711 shaped in a column surrounding a central axis RA along the coil axis direction. In the present embodiment, the first contactor 71 is formed in a cylindrical shape having an axial direction substantially parallel to the coil axis LA. A distal end portion 712 of the first contactor 71 in the return direction is arranged to face the second contactor 72 in the coil axis direction.

A flange portion 714 is formed in the intermediate portion 713 of the first contactor 71 in the longitudinal direction. The flange portion 714 protrudes outward from the outer side surface 711 (that is, in a direction away from the central axis RA). The flange portion 714 is covered with the oscillation supporting portion 73. The oscillation supporting portion 73 includes an insulating elastic member provided in close contact with the outer side surface 711 of the first contactor 71, and is integrally formed of synthetic rubber or the like. The oscillation supporting portion 73 is fixed to the first contactor 71 such that the flange portion 714 restrains the relative movement of the oscillation supporting portion 73 along the central axis RA with respect to the first contactor 71.

The first contactor 71 is attached to the protruding portion of the frame 3 through the oscillation supporting portion 73. That is, the first contactor 71 is supported by the oscillation supporting portion 73 to allow the central axis RA to oscillate.

Further, in the present embodiment, the pair of first contactors 71 are arranged in the width direction. One and the other of the pair of first contactors 71 are arranged substantially symmetrically with respect to the coil axis LA. The first contactors 71 are electrically insulated from each other by the frame 3 and the oscillation supporting portion 73 in a state of being separated from the second contactor 72 in the coil axis direction. In the case where the electromagnetic relay 1 is mounted on an electric vehicle in the above application, one of the first contactors 71 is electrically connected to a drive circuit for an electric motor and the other is electrically connected to the battery.

The second contactor 72 is a conductive contact member made of conductive metal and is formed in a substantially flat plate shape having a thickness direction parallel to the coil axis direction. The second contactor 72 is opposed to the first contactor 71 in the coil axis direction so as to be in electrical contact with the first contactor 71 by being in contact with the first contactor 71. Further, the second contactor 72 is provided to be reciprocally movable along the coil axis direction while being guided by the frame 3. In the present embodiment, the second contactor 72 is arranged across the pair of first contactors 71 in the width direction to be in contact with the pair of first contactors 71 to electrically connect the pair of first contactors 71 with each other.

An opposing surface 721, which is one of a pair of main surfaces of the second contactor 72, is provided to face the pair of first contactors 71. A back surface 722, which is the other main surface of the second contactor 72, is provided to be in contact with the contact pressure spring 74.

The contact pressure spring 74 is a compression coil spring and is disposed between the second contactor 72 and the contact cover 75 so as to bias the second contactor 72 toward the pair of first contactors 71 in the suction direction. The contact cover 75 is made of an insulating material such as a synthetic resin and is formed in a substantially U-shape so as to cover the pair of first contactors 71 and the second contactor 72. Both ends of the substantially U-shaped contact cover 75 are fixed to the frame 3.

The contact point device 70 has a first contact portion 761 and a second contact portion 762. In the present embodiment, the first contact portion 761 is provided on the second contactor 72, and the second contact portion 762 is provided on the first contactor 71.

The first contact portion 761 is formed in a protruding shape protruding from the opposing surface 721 of the plate-shaped second contactor 72 toward the first contactor 71. Specifically, in the present embodiment, the outer surface of the first contact portion 761 facing the second contact portion 762 has a cylindrical side surface, a top surface shaped in substantially circular, and a curved surface provided between the side surface and the top surface, such as partial spherical surface shape or conical surface shape.

In the present embodiment, plural first contact portions 761 are provided so as to face the respective first contactors 71. That is, a first group of the first contact portions 761 corresponding to one of the pair of first contactors 71 is arranged on one end in the width direction of the second contactor 72. A second group of the first contact portions 761 corresponding to the other of the pair of first contactors 71 is arranged on the other end in the width direction of the second contactor 72.

Figure 4:
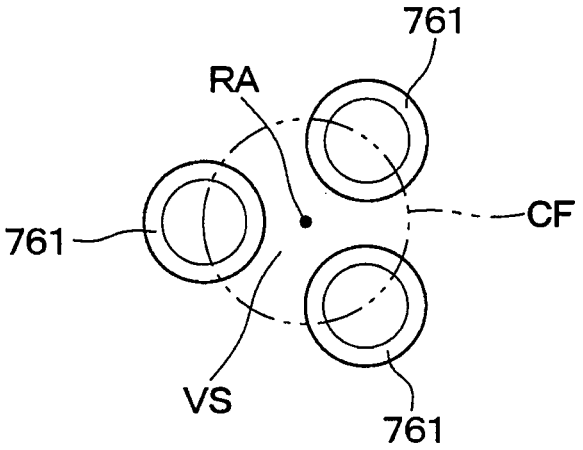
FIG. 4 is an enlarged bottom view illustrating a periphery of the first contact portion shown in FIG. 2.

FIG. 4 is an enlarged view showing a group of first contact portions 761 provided corresponding to one of the pair of first contactors 71. As shown in FIG. 4, the group of first contact portions 761 are arranged at equal intervals on the circumference CF surrounding the central axis RA. More specifically, the group of first contact portions 761 are arranged such that, in the plan view, the center points are located at equal intervals in the circumferential direction on the circumference CF. Further, in the present embodiment, three first contact portions 761 are provided on one circumference CF. The circumference CF is a curve on the opposing surface 721 substantially perpendicular to the central axis RA, and corresponds to a circle formed around the intersection of the central axis RA and the opposing surface 721.

Figure 2:
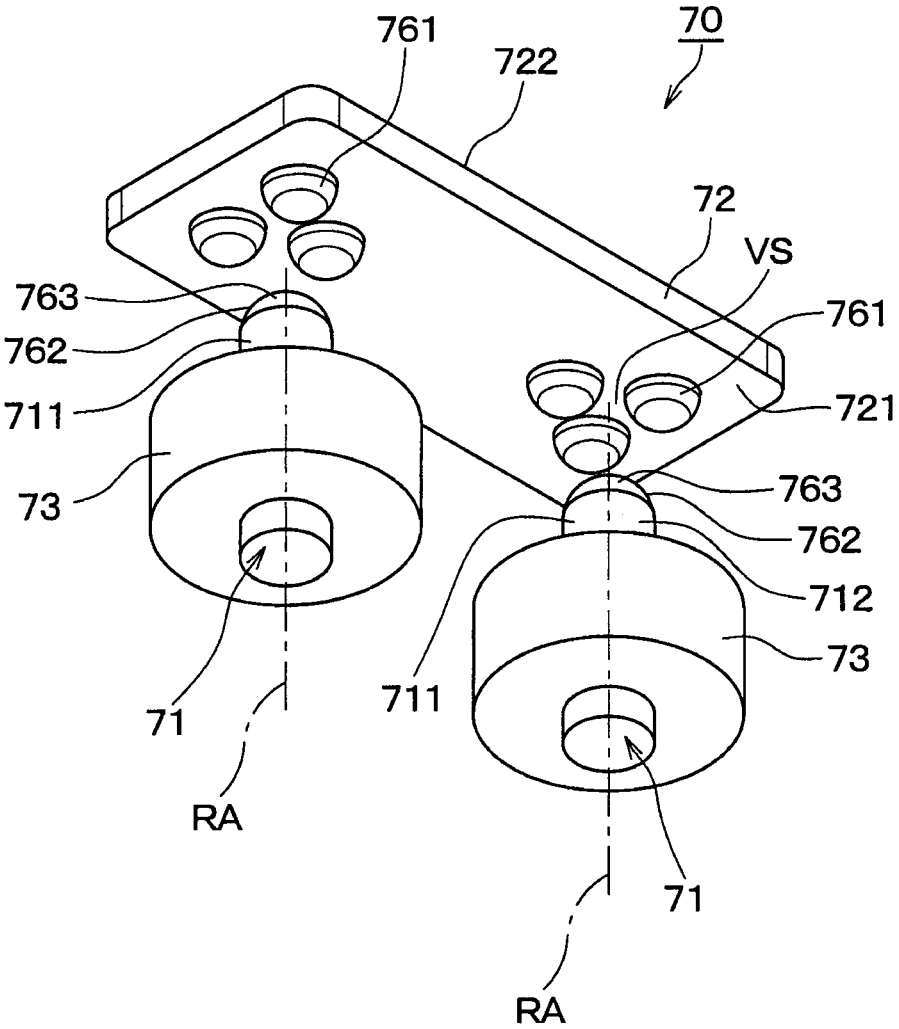
FIG. 2 is an enlarged perspective view illustrating a part of the contact point device shown in FIG. 1.
Figure 3:
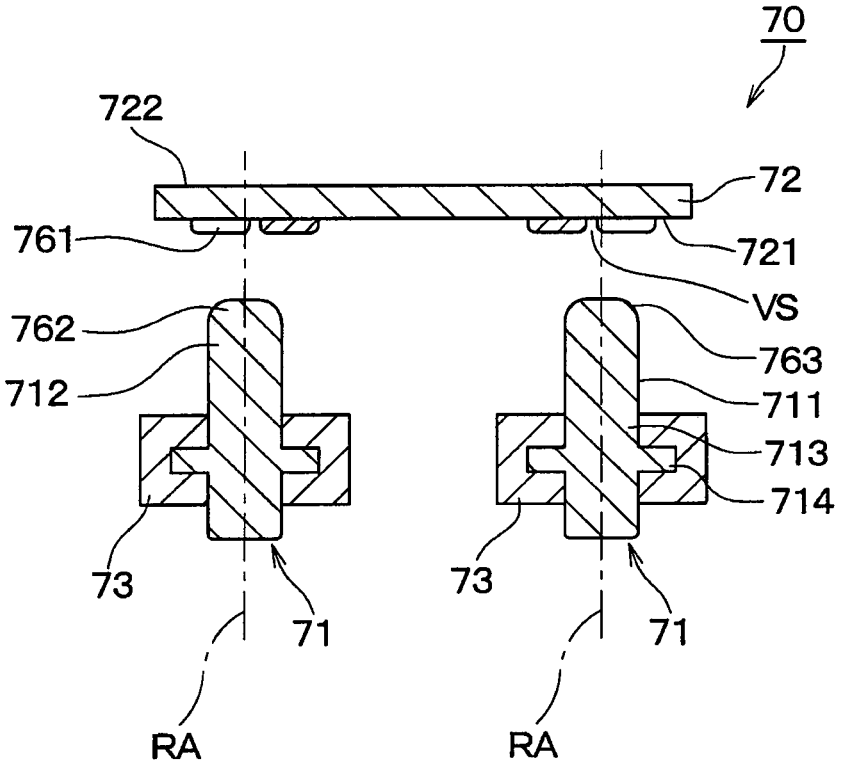
FIG. 3 is a cross-sectional view of the contact point device shown in FIG. 2.

The second contact portion 762 is provided at the distal end portion 712 of each of the pair of first contactors 71. As shown in FIGS. 2 to 4, the second contact portion 762 protrudes in the coil axis direction toward the virtual space VS surrounded by the plural first contact portions 761.

The second contact portion 762 has a contact surface 763. The contact surface 763 is a convex curved surface that is exposed toward the virtual space VS and is formed to surround the central axis RA. Specifically, in the present embodiment, the entire contact surface 763 is formed in a partially spherical shape.

(Operation and Effect of Embodiment)

Hereinafter, the operation and effect achieved by the present embodiment will be described with reference to FIGS. 1 to 4.

When the energization of the coil 4 is interrupted, the movable core 61 is separated from the fixed core 51 by the urging force of the return spring 64 in the return direction. As a result, the movable shaft 62 integrated with the movable core 61 moves in the return direction.

When the movable shaft 62 moves in the return direction, the movable insulator 63 fixed to the tip end of the movable shaft 62 abuts against the second contactor 72 at a position between the first contact portions 761. Then, when the movable shaft 62 further moves in the return direction, the second contactor 72 moves in the return direction against the biasing force of the contact pressure spring 74. As a result, as shown in FIG. 1, the first contact portion 761 and the second contact portion 762 are separated from each other, and the energization therebetween is interrupted.

When the energization of the coil 4 is started, the movable core 61 is attracted to the fixed core 51 by the magnetic field generated by the coil 4. Then, the movable core 61 moves in the suction direction to a position close to the fixed core 51 against the urging force of the return spring 64.

When the movable core 61 moves in the suction direction, the movable shaft 62 and the movable insulator 63 also move in the suction direction. Then, the second contactor 72 moves in the suction direction to approach the first contactor 71 by the urging force of the contact pressure spring 74 in the suction direction.

The second contact portion 762 provided at the distal end portion 712 of the first contactor 71 and the first contact portion 761 provided at the opposing surface 721 of the second contactor 72 abut each other, whereby the first contactor 71 and the second contactor 72 are electrically connected. That is, a current flow path is formed from one of the pair of first contactors 71 via the second contactor 72 to the other of the pair of first contactors 71.

In the present embodiment, the second contact portion 762 provided at the distal end portion 712 of the first contactor 71 advances into the virtual space VS. As a result, the contact surface 763, which is a curved surface provided on the second contact portion 762 to surround the central axis RA of the first contactor 71, is in contact with the outer surfaces of the first contact portions 761 facing the virtual space VS.

At this time, the first contactor 71 is supported by the oscillation supporting portion 73 to be able to oscillate. Therefore, the contact surface 763, which is a curved surface exposed toward the virtual space VS on the second contact portion 762 provided at the distal end portion 712 of the first contactor 71, suitably abuts all of the contact portions 761 facing the virtual space VS.

Due to manufacturing errors or the like, there is a possibility that the central axis RA of the first contactor 71 does not pass through the center of the circumference CF on which the group of the first contact portions 761 is disposed when the coil 4 is de-energized. Alternatively, for example, due to manufacturing errors or the like, one of the first contact portions 761 may have the protrusion amount in the coil axis direction or the outer diameter, which is smaller than the others.

In this respect, according to the present embodiment, the central axis RA of the first contactor 71 moderately oscillates due to the force applied to the first contactor 71 when the first contact portion 761 and the second contact portion 762 are brought into contact. This oscillation can be a three-dimensional oscillation such as a precession movement, in particular, a conical precession movement. Therefore, even in the above-described case, the second contact portion 762 provided at the distal end portion 712 of the first contactor 71 can abut all of the corresponding group of the first contact portions 761 satisfactorily.

As described above, according to the present embodiment, the second contact portion 762 and the plural first contact portions 761 are in contact in a stable manner in the region where the first contactor 71 and the second contactor 72 come close to and oppose each other. Therefore, the contact resistance between the first contactor 71 and the second contactor 72 is satisfactorily reduced. That is, according to the present embodiment, it is possible to satisfactorily reduce the contact resistance during energization without lowering in the reliability which may be caused by change in the material of the contact member or without increase in the size of the device which may be caused by rise in the contact pressure.

In addition, since the first contactor 71 is supported to oscillate, a strict parallelism is not required between the normal line of the opposing surface 721 and the central axis RA. The strictness is also not required in the positional relationship relative to the center of the circumference CF. Therefore, according to the present embodiment, the designing can be made flexible for the electromagnetic relay 1 and the contact point device 70.

(Modifications)

The present disclosure is not limited to the specific examples described in the above-described embodiment. That is, it is possible to appropriately change the above-described embodiment. Representative modifications will be described below. In the following description of variation examples, only the features different from those of the embodiments described above will be explained. In addition, in the above-described embodiment and the modifications, the same reference numerals are given to the same or equivalent parts. Therefore, in the description of the following modifications, regarding components having the same reference numerals as the components of the above-described embodiment, the description in the above-described embodiment can be appropriately cited unless there is a technical inconsistency or a specific additional explanation.

As described above, the electromagnetic relay 1 and the contact point device 70 according to the present disclosure have the plunger structure, and can satisfactorily cope with an increase in system output in the electric vehicle. However, the electromagnetic relay 1 and the contact point device 70 according to the present disclosure are not limited to be applied to the power transmission path between the motor drive circuit and the battery in the electric vehicle. That is, the electromagnetic relay 1 and the contact point device 70 are not limited to being mounted on a vehicle. Further, the electromagnetic relay 1 is not limited to the plunger type.

The present disclosure is not limited to the specific examples described in the above-described embodiment. For example, the configurations of the fixed portion 5 and the movable portion 6 are not limited to the above specific examples.

For example, the shapes of the fixed core 51, the movable core 61, and the like can be appropriately changed from the shapes shown in FIG. 1. Specifically, for example, the movable core 61 can be fixed to an end portion of the movable shaft 62 in the suction direction. In this case, the fixed core 51 has no function of guiding the reciprocating movement of the movable shaft 62. That is, in this case, the guide hole 52 is not formed in the fixed core 51.

The shape of the first contactor 71 is not limited to the above specific example. That is, for example, the first contactor 71 may be formed in a tubular shape having a through hole along the central axis RA. Further, instead of the flange portion 714, a groove portion can be formed. Alternatively, for example, a portion of the first contactor 71 other than the distal end portion 712 may be formed into a polygonal prism shape. In this case, the flange portion 714 or the groove portion to replace the flange portion 714 can be omitted by providing the oscillation supporting portion 73 to straddle the polygonal prism portion and the columnar portion.

The oscillation manner of the oscillation supporting portion 73 supporting the first contactor 71 is not limited to the above specific example. That is, for example, the oscillation supporting portion 73 may be provided to expose the intermediate portion 713 while the end portion of the first contactor 71 opposite to the distal end portion 712 is covered. Alternatively, the oscillation supporting portion 73 may be provided to cover substantially the entirety (that is, a portion other than the distal end portion 712) of the outer side surface 711 of the first contactor 71.

There is also no particular limitation on the shape and structure of the oscillation supporting portion 73. That is, for example, the outer shape of the oscillation supporting portion 73 may be a substantially cylindrical shape as shown in FIG. 2, or may be a polygonal prism shape. Further, the oscillation supporting portion 73 may include a member other than the elastic member. That is, for example, the oscillation supporting portion 73 may include an elastic member covering the outer side surface 711 of the first contactor 71 and a tubular rigid member covering the outer peripheral surface of the elastic member.

The entirety of the outer surface of the first contact portion 761 facing the second contact portion 762 may be formed in a partially spherical shape. Alternatively, a portion of the first contact portion 761 which does not contact the second contact portion 762 can be omitted as appropriate. That is, for example, the first contact portion 761 can be formed in a partial columnar shape such as a semicircular column shape. The contact surface 763 of the second contact portion 762 may include a cylindrical side surface that surrounds the central axis RA, a top surface shaped in substantially circular, and a ring-shaped partial spherical surface or a conical curved surface provided to surround the central axis RA, between the cylindrical side surface and the top surface.

The first contact portion 761 is not limited to the protrusion protruding from the opposing surface 721 of the second contactor 72 along the coil axis direction. Hereinafter, such modifications will be described.

Figure 5:
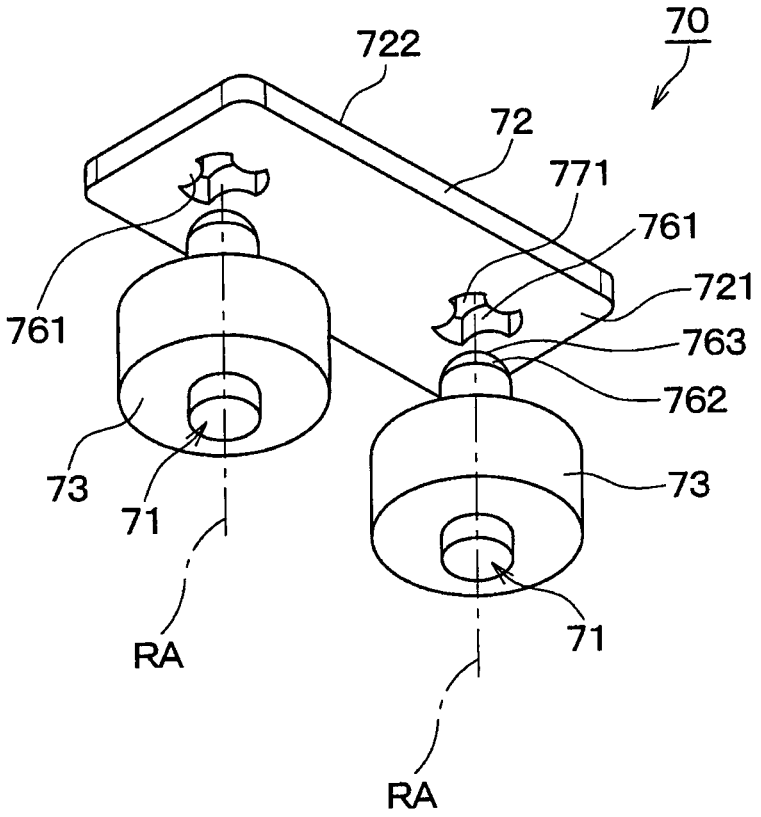
FIG. 5 is a perspective view illustrating a schematic configuration of a contact point device according to a modification of the embodiment.
Figure 6:
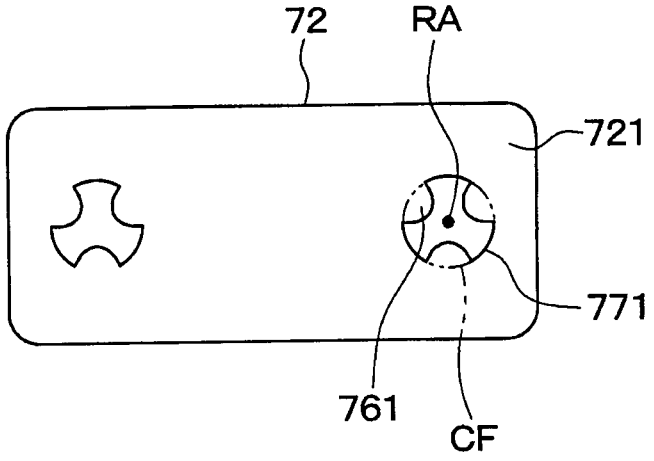
FIG. 6 is a bottom view or a plan view illustrating a second contactor shown in FIG. 5.

As shown in FIGS. 5 and 6, the first contact portion 761 may be a protrusion protruding toward the center of a contact forming hole 771 penetrating the second contactor 72 in the thickness direction. Such protrusions may be formed in a partial columnar shape (for example, a semicircular column shape) having an axial direction parallel to the thickness direction of the second contactor 72.

The first contact portions 761 are arranged at equal intervals on the circumference CF. In this case, the circumference CF corresponds to a circumference forming an inner circumference of a circular hole, assuming that the contact forming hole 771 is shaped such that the first contact portions 761 protrude from the inner peripheral surface of the circular hole. Also in this modification, three first contact portions 761 are provided on one circumference CF. The three first contact portions 761 are formed to surround the central axis RA on the opposing surface 721 or the back surface 722 of the second contactor 72.

In such a configuration, the second contact portion 762 provided at the distal end portion 712 of the first contactor 71 enters the opening formed by the contact forming hole 771. Then, the contact surface 763, which is a curved surface exposed toward the contact forming hole 771 at the distal end portion 712 of the first contact piece 71, contacts all of the plural first contact portions 761 facing the contact forming hole 771. The same effects as those of the embodiment described above can be achieved with this structure.

As described above, the above-mentioned protrusion forming the first contact portion 761 may have a semi-cylindrical shape or may not have a semi-cylindrical shape. In the former case, the central axis of the cylindrical surface of the protrusion is located on the circumference CF. In the latter case, the central axis of the cylindrical surface of the protrusion is not located on the circumference CF.

In FIGS. 5 and 6, the contact forming hole 771 may not be a through hole. That is, the contact forming hole 771 may be a recessed portion closed on the back surface 722. Further, the inner side of the circumference CF on the opposing surface 721 may be formed in a concave shape.

Figure 7:
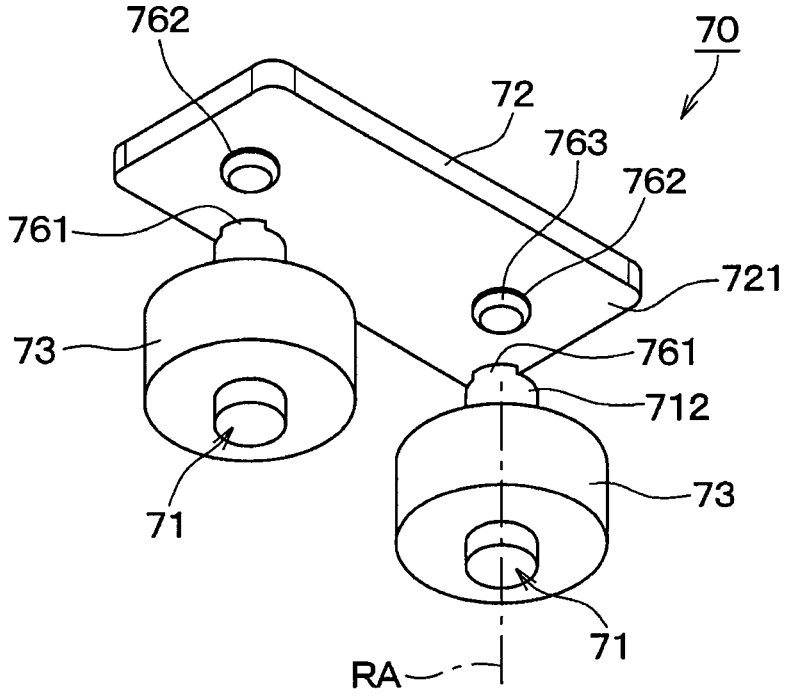
FIG. 7 is a perspective view illustrating a schematic configuration of a contact point device of another modification of the embodiment.
Figure 8:
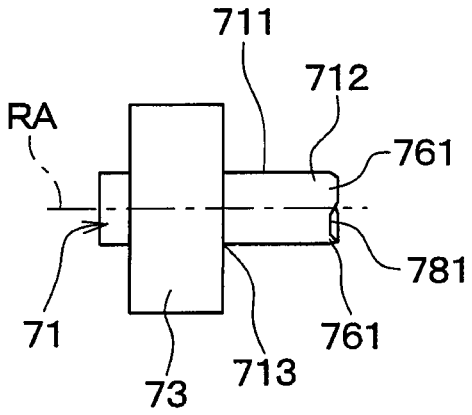
FIG. 8 is a side view illustrating a first contactor and an oscillation supporting portion shown in FIG. 7.
Figure 9:
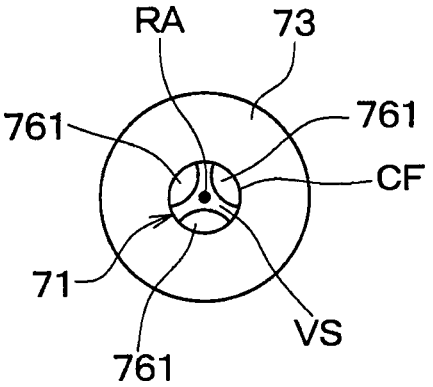
FIG. 9 is a plan view or a bottom view of the first contactor and the oscillation supporting portion shown in FIG. 8.

As shown in FIGS. 7 to 9, plural first contact portions 761 may be provided at the distal end portion 712 of the first contactor 71, while the second contact portion 762 may be provided on the second contactor 72. The same effects as those of the embodiment described above can be achieved with this structure.

In this case, the first contact portion 761 protrudes from the end face 781 of the first contactor 71 adjacent to the distal end portion 712 along the central axis RA. That is, the plural first contact portions 761 are provided to surround the central axis RA on the end face 781 which is a plane perpendicular to the central axis RA.

The first contact portion 761 is provided as a columnar protrusion formed by connecting two partial cylindrical surfaces whose respective generatrices are parallel to the central axis RA and protrude in opposite directions. One of the two partial cylindrical surfaces forming the outer side surface of the first contact portion 761 is formed to be continuous with the outer side surface 711 of the intermediate portion 713. That is, the partial cylindrical surface is provided so as to constitute a part of the cylindrical outer side surface 711 of the first contactor 71.

Also in this modification, three first contact portions 761 are provided at equal intervals on one circumference CF. In this case, as shown in FIG. 9, the circumference CF corresponds to the outer shape of the first contactor 71 in a plan view. Further, the second contact portion 762 protrudes in the coil axis direction from the opposing surface 721 of the second contactor 72 toward the virtual space VS surrounded by one pair (ie, three) of the first contact portions 761.

Figure 10:
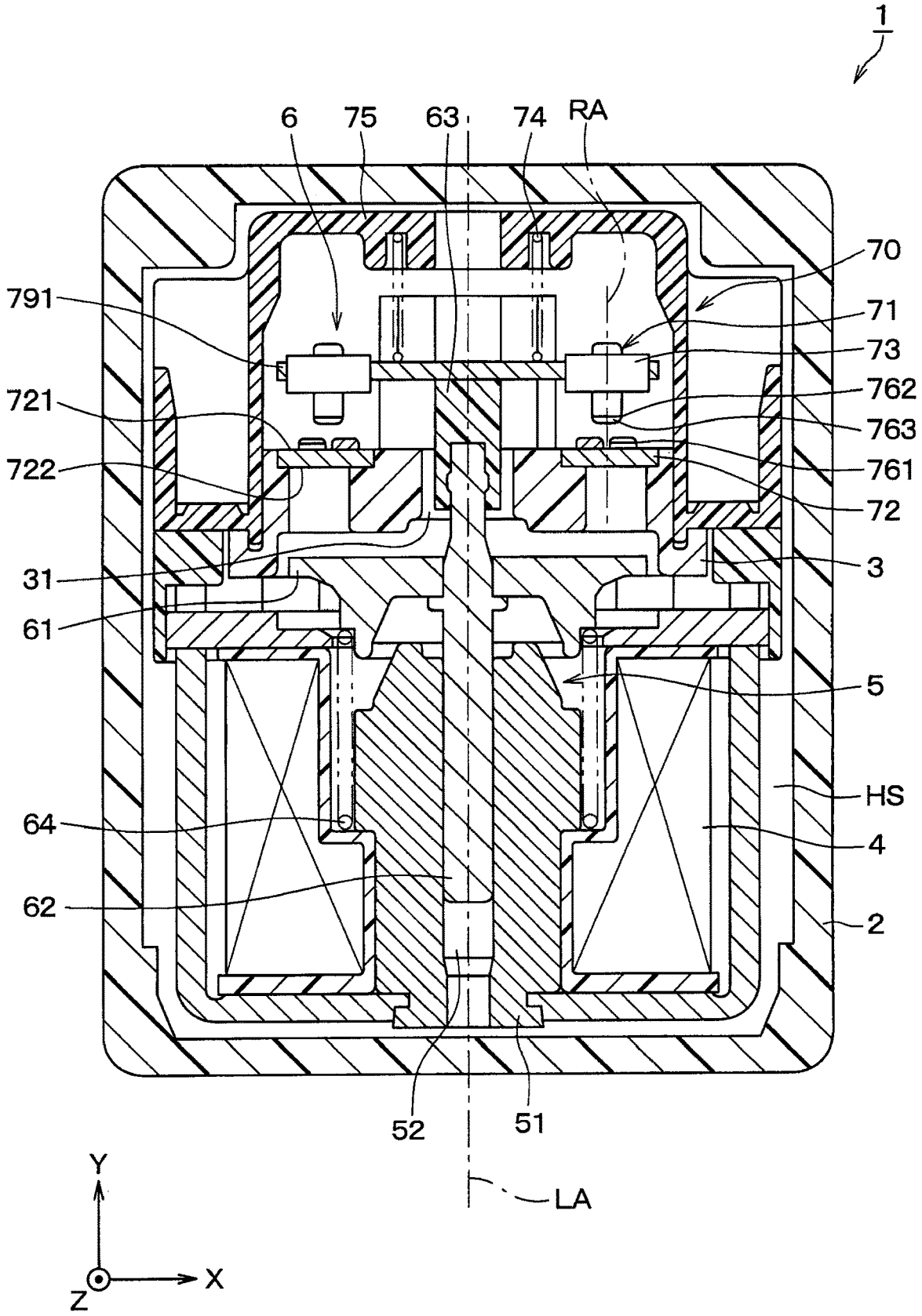
FIG. 10 is a cross-sectional view illustrating a schematic configuration of an electromagnetic relay and a contact point device according to another modification of the embodiment.

As shown in FIG. 10, the first contactor 71 may be provided on the movable portion 6, whereas the second contactor 72 may be provided on the fixed portion 5. The same effects as those of the embodiment described above can be achieved with this structure.

Specifically, in this modification, the first contactor 71 is attached to a movable plate 791 via the oscillation supporting portion 73. Like the second contactor 72 in the above embodiment, the movable plate 791 is a conductive contact member made of conductive metal and is formed in a substantially flat plate shape having a thickness direction parallel to the coil axis direction.

Also in this modification, one and the other of the pair of first contactors 71 arranged in the width direction are arranged substantially symmetrically with respect to the coil axis LA. Each of the first contactors 71 is electrically connected to the movable plate 791 via a wiring portion (not shown).

The second contactor 72 is fixed to the protrusion of the frame 3. In this modification, a pair of second contactors 72 are provided respectively to the pair of first contactors 71. When the coil 4 is not energized, the pair of second contactors 72 are electrically insulated from each other by the frame 3, in a state where the first contactor 71 is separated from the second contactor 72.

FIG. 10 shows an example in which plural first contact portions 761 are provided on the second contactor 72 and a second contact portion 762 is provided on the first contactor 71, similarly to the above embodiment. That is, in FIG. 10, each of the second contactors 72 has plural first contact portions 761. The detailed structure of the contact point device 70 in FIG. 10 is the same as that shown in FIGS. 2 to 4 except that the second contactor 72 is divided into two.

In FIG. 10, the oscillation supporting portion 73 may be formed of a conductive material. That is, the pair of first contactors 71 may be electrically connected to each other via the oscillation supporting portion 73 and the movable plate 791. Further, modifications corresponding to FIGS. 5 and 6 or modifications corresponding to FIGS. 7 to 9 can be applied to the modification shown in FIG. 10.

Two first contact portions 761 may be provided on one circumference CF. Alternatively, four or more first contact portions 761 may be provided on one circumference CF. In case where three or more first contact portions 761 are provided on one circumference CF, the first contact portions 761 may be arranged at equal or non-equal intervals on the circumference CF.

In the above description, the seamlessly integrally formed member may be configured to have a seam due to adhesion among plural members or the like. Likewise, the plural members separately provided may be joined integrally and seamlessly to each other. There is no particular limitation on the material forming each member.

The modifications are not limited to the above description. Plural modifications may be combined with each other. Furthermore, some of the configurations in the above embodiment and some configurations in each of the above modifications can be combined with each other.

What is claimed is:

1. A contact point device configured to switch an electric current to flow or not by relative movement between a movable portion and a fixed portion, the contact point device comprising:

a first contactor provided on one of the movable portion and the fixed portion as a conductive contact member having an outer side surface shaped in a column that surrounds a central axis along a relative movement direction of the movable portion and the fixed portion;

an oscillation supporting portion that supports the first contactor at the one of the movable portion and the fixed portion to allow the central axis to oscillate; and a second contactor provided on the other of the movable portion and the fixed portion as a conductive contact member disposed opposite to the first contactor in the relative movement direction so as to be electrically connected to the first contactor by abutting against the first contactor, wherein one of the first contactor and the second contactor includes a plurality of first contact portions provided to surround the central axis on a plane perpendicular to the central axis, the other of the first contactor and the second contactor includes a second contact portion provided to protrude in the relative movement direction toward a space surrounded by the plurality of the first contact portions, and the second contact portion has a contact surface which is a curved surface exposed toward the space to surround the central axis.

2. The contact point device according to claim 1, wherein the plurality of first contact portions comprises: three of first contact portions equally spaced from each other on a circumference surrounding the central axis.

3. The contact point device according to claim 1, wherein the oscillation supporting portion includes an elastic member in close contact with the outer side surface of the first contactor.

4. The contact point device according to claim 1, wherein the first contactor is attached to the fixed portion through the oscillation supporting portion, and the second contactor is provided on the movable portion.

5. The contact point device according to claim 1, wherein the plurality of first contact portions are provided on the second contactor, and the second contact portion is provided at a tip end portion of the first contactor.

6. The contact point device according to claim 5, wherein the second contactor has a plate shape, and the first contact portion has a protruding shape protruding from the second contactor toward the first contactor.

7. The contact point device according to claim 1, wherein the plurality of first contact portions are provided at a tip end portion of the first contactor, and the second contact portion is provided on the second contactor.

8. An electromagnetic relay configured to switch an electric current to flow or not by a movement of a movable portion relative to a fixed portion in a coil axis direction based on an energization state of a coil, the electromagnetic relay comprising:

a first contactor provided on one of the movable portion and the fixed portion as a conductive contact member having an outer side surface shaped in a column that surrounds a central axis along the coil axis direction;

an oscillation supporting portion that supports the first contactor at the one of the movable portion and the fixed portion to allow the central axis to oscillate; and a second contactor provided on the other of the movable portion and the fixed portion as a conductive contact member disposed opposite to the first contactor in the coil axis direction so as to be electrically connected to the first contactor by abutting against the first contactor, wherein one of the first contactor and the second contactor includes a plurality of first contact portions provided to surround the central axis on a plane perpendicular to the central axis, the other of the first contactor and the second contactor includes a second contact portion provided to protrude in the coil axis direction toward a space surrounded by the plurality of the first contact portions, and the second contact portion has a contact surface which is a curved surface exposed toward the space to surround the central axis.

9. The electromagnetic relay according to claim 8, wherein the plurality of first contact portions comprises: three of first contact portions equally spaced from each other on a circumference surrounding the central axis.

10. The electromagnetic relay according to claim 8, wherein the oscillation supporting portion includes an elastic member in close contact with the outer side surface of the first contactor.

11. The electromagnetic relay according to claim 8, wherein the first contactor is attached to the fixed portion through the oscillation supporting portion, and the second contactor is provided on the movable portion.

12. The electromagnetic relay according to claim 8, wherein the plurality of first contact portions are provided on the second contactor, and the second contact portion is provided at a tip end portion of the first contactor.

13. The electromagnetic relay according to claim 12, wherein the second contactor has a plate shape, and the first contact portion has a protruding shape protruding from the second contactor toward the first contactor.

14. The electromagnetic relay according to claim 8, wherein the plurality of first contact portions are provided at a tip end portion of the first contactor, and the second contact portion is provided on the second contactor.

15. The electromagnetic relay according to claim 8, wherein the first contactor is one of a pair of first contactors arranged in a width direction perpendicular to the coil axis direction to be electrically insulated from each other in a state of being separated from the second contactor, and the second contactor is located over the pair of first contactors in the width direction to electrically connect the pair of first contactors with each other by making contact with the pair of first contactors.

* * * * *